United States Patent [19]

Opitz et al.

[11] Patent Number: 4,956,016

[45] Date of Patent: Sep. 11, 1990

[54] ANTICORROSIVE AGENTS AND USE THEREOF

[75] Inventors: Reinhard Opitz, Dueren; Lutz Schellenberg, Koeln, both of Fed. Rep. of Germany

[73] Assignee: Gerhard Collardin GmbH, Koeln-Ehrenfeld, Fed. Rep. of Germany

[21] Appl. No.: 316,889

[22] Filed: Feb. 28, 1989

[30] Foreign Application Priority Data

Mar. 2, 1988 [DE] Fed. Rep. of Germany ..... 3806675

[51] Int. Cl.[5] ..... C09D 5/08; C23F 11/18

[52] U.S. Cl. ..... 106/14.12; 106/18.13; 252/389.23; 252/389.4

[58] Field of Search ..... 252/389.3, 389.23, 389.4; 106/18.13; 148/261

[56] References Cited

U.S. PATENT DOCUMENTS 4,705,665 11/1987 Malik .
4,714,564 12/1987 Lynch et al. ..... 252/110

FOREIGN PATENT DOCUMENTS 847534 7/1958 European Pat. Off. .
8606417 6/1986 Int'l Pat. Institute .

OTHER PUBLICATIONS

Chem Abstracts 78:126044w, Shoring et al., 1972.
Chemical Abstract, vol. 92, #80886f.
Chemical Abstract, vol. 82, #36672c.
Konservierung von Dampferzeugeranlagen 268–271.

*Primary Examiner*—Paul Lieberman
*Assistant Examiner*—Helene Klemanski
*Attorney, Agent, or Firm*—Ernest G. Szoke; Wayne C. Jaeschke; Norvell E. Wisdom, Jr.

[57] ABSTRACT

Corrosion inhibitors containing a mixture of one or more water soluble tetraborate salts and one or more water soluble condensed phosphate salts are non-toxic and are more effective than either of the components alone. These compositions containing both tetraborates and condensed phosphates are also more effective than such prior art inhibitors as nitrites and ethanolamine-based inhibitors.

16 Claims, No Drawings

ANTICORROSIVE AGENTS AND USE THEREOF

FIELD OF THE INVENTION

The invention relates to new corrosion inhibitors for the protection of iron, zinc and nonferrous metals and the use of these inhibitors in the form of aqueous solutions. In this application, the term "(corrosion) inhibitor" is to be understood as including both materials that reduce corrosion by their presence in environments to which which metals are exposed and materials that, by virtue of having once been in contact with metal surfaces, provide them with enhanced future resistance to corrosion, even in environments where the protective agent is no longer present.

STATEMENT OF RELATED ART

In processing the surfaces of shaped parts made of metals or metal alloys by means of chemical or mechanical processing operations, there are formed, at least temporarily, regions where active metal atoms are in direct contact with the oxygen and the moisture of the surrounding air. Thus, for example, machining shaped metal parts or sand blasting of metallic surfaces provides bright bare metal which is immediately oxidized by oxygen and moisture. Chemical methods of surface treatment also create highly active metal surfaces which are rapidly corroded. During the storage of such metallic workpieces, exclusion of corrosive influence of the environment is frequently impossible. Thus, it is useful prior to storage to treat such metallic workpieces with corrosion inhibitors. Undesirable corrosion is thus prevented at least for a short period of time.

In most such cases, protection from corrosion is provided by treating the metallic work pieces with alkaline aqueous solutions containing one or more corrosion inhibitors. These inhibitors become attached to the active metal surface and thereby hinder the immediate contact of the metallic surfaces with corrosive substances. Moreover, the inhibitor layer is readily removable later on by aqueous solutions of cleaning agents, to provide an active metallic surface suitable for subsequent reactions, for example phosphating to form a layer or applying an anticorrosive permanent surface coating such as paint.

Numerous materials have been taught as corrosion inhibitors in prior art. For example, a strongly alkaline treating solution effectively prevents the corrosion of shaped parts made of iron and its alloys; however, it cannot be used with numerous other metals due to the fact that these form soluble complexes in strongly alkaline medium. Moreover, working with highly concentrated alkali hydroxides involves many safety risks.

In addition, sodium nitrite has been used as a corrosion inhibitor for numerous metals. Nitrite containing corrosion inhibitors were favored for a long time because they provide reliably good corrosion inhibition. They were also employed as a standard for the assessment of the corrosion-inhibiting action of other substances (cf., for example, WO-A-86/06417, pp. 10 et sec.). Recently, however, the use of nitrite-containing corrosion inhibitors has been more and more restricted, because they are harmful to health. Moreover, it was found that use of too low an amount of nitrite-containing corrosion inhibitors results in just the reverse of what is desired, namely an increased corrosion of the metal surfaces treated. Thus, the use of corrosion inhibitors which contain nitrite is being reduced.

The corrosion-inhibiting effect of ammonia and amines, and more specifically of alkanolamines having 2 or 3 carbon atoms in the alkanol residue, has also been known for a long time. Diethanolamine, triethanolamine, diisopropanolamine and triisopropanolamine have been recommended for use in compositions for inhibiting the corrosion on metal surfaces. However, more recently such corrosion inhibitors have been classified as toxic, and for this reason they are used to a continuously lessening extent. The use of these inhibitors is also to be avoided for ecological reasons, since they are not biodegradable to the degree now considered desirable.

Corrosion inhibitors are also commonly added to the water of cooling units and steam generators in order to prevent the water-conducting parts of the system from being damaged due to corrosion. The amount of downtime due to accidents or maintenance can be reduced, if the circulating water contains inhibitors. In addition to the substances mentioned above, hydrazine may be used, for example, in such systems. Thus, in *Handbuch Wasser*, Vulkanverlag, Essen (1979), p. 270, there is disclosed a formula of 200 mg of hydrazine per kg of water and 100 ml of trisodium phosphate per kg of water which at a pH value of 10.5 guarantees a satisfactory protection from corrosion during periods of plant shutdown. The harmful effects of hydrazine to health (it is believed to be carcinogenic), however, virtually prohibits the use of such hydrazine-containing corrosion inhibitors, particularly in open systems.

It is an object of this invention to provide a nontoxic inhibitor that will provide at least temporary protection from corrosion to metallic surfaces, will be easy to handle in practice, will exhibit a good inhibitory effect even at comparably low concentrations, will be more or less completely soluble in aqueous systems, and will be useful at elevated temperature and in very hard waters.

DESCRIPTION OF THE INVENTION

It has now surprisingly been found that salt mixtures containing borates and condensed phosphates provide good protection from corrosion even at low concentrations. This was particularly surprising because the individual substances in the same total concentrations had no anticorrosive effect at all or only an insufficient anticorrosive effect, whereas phosphates and borates in combination effectively inhibit the corrosion of metallic workpieces.

Except in the operating examples, or where otherwise explicitly specified, all numbers in this description that specify amounts of materials or reaction or use conditions are to be understood as modified by the word "about".

The inhibitors according to the invention contain one or more water-soluble tetraborate(s) as an essential component. Such components correspond to the general formula $M_2B_4O_7$, where M represents a monovalent cation or an appropriate fraction of a higher valent cation. The scope of the invention includes all such compounds that are sufficiently soluble in water and yield ionic solutions. Preferred are the alkali metal tetraborates, among which sodium tetraborate is particularly preferred because of its good solubility in water. However, other tetraborates such as potassium tetraborate are also suitable.

The inhibitors according to the invention contain one or more water-soluble condensed phosphate(s) as a second essential component. These phopshates should be sufficiently soluble in water. Preferably used as condensed phosphates are the alkali metal salts, sodium phosphates being particularly preferred. The term "condensed phosphate(s)" as used hereinafter is to be understood to denote compounds having a chemical structure that can be formed by condensation with one another of phosphate ($PO_4^{3-}$) residues with removal of water at an elevated temperature. Thus, for example, diphosphates or pyrophosphates are formed by condensation of two phosphate residues, the obtained compound(s) being converted to triphosphate(s) and higher polyphosphates by addition of phosphate group(s) and elimination of water. Preferred inhibitors according to the invention contain, as the condensed phosphate component, pyrophosphates and/or tripolyphosphates, among which pentasodium tripolyphosphate and/or tetrasodium pyrophosphate are particularly preferred.

The inhibitors according to the invention may further contain water as an optional component. Although in one preferred embodiment it is most desirable to formulate the inhibitors according to the invention as dry powders, such powders nevertheless may contain water of crystallization. Sodium tetraborate, sodium tripolyphosphate, and tetrasodium pyrophosphate, are all preferably used in the form of their salts containing water of crystallization, such as sodium tetraborate decahydrate ($Na_2B_4O_7 \cdot 10H_2O$) and tetrasodium pyrophosphate decahydrate ($Na_4P_2O_7 \cdot 10H_2O$).

The ratio of the tetraborate component(s) and the condensed phosphate component(s) in the inhibitors according to the invention may vary over a wide range. In preferred embodiments the inhibitors according to the invention contain one or more water-soluble tetraborate(s), preferably sodium tetraborate, and one or more water-soluble condensed phosphate(s), preferably tetrasodium pyrophosphate and/or pentasodium tripolyphosphate in a ratio by weight of from 2:3 to 9:1. Within this—relatively broad—range a ratio by weight of the tetraborate component(s) to the condensed phosphate component(s) of 1:1 is particularly preferred.

The inhibitors according to the invention may be prepared in a manner known from prior art. The preparation is usually effected simply by mixing the tetraborate component(s) and the condensed phosphate component(s) together as salts. Such mixtures may be sold directly as corrosion inhibitors. Mixing in powder form has the advantage of that the amounts of water present in liquid formulations need not be transported from the manufacturer to the user. The product formulated in the powdery state is instead stored and shipped and may then be mixed with water by simple measures at the site of application.

Upon dilution with water, after brief stirring or forced circulation, there are formed aqueous solutions which may then be used to apply the inhibitor onto metallic workpieces. Preferably such aqueous solutions comprise a total solids content of from 1 to 5% by weight. Accordingly, mixtures of one or more water-soluble tetraborate(s) and one or more water-soluble condensed phosphate(s) in an amount of from 10 to 50 grams are contained in one kilogram of the aqueous solutions.

It is further preferred that aqueous solutions to be used according to this invention have a pH value of from 7 to 11, while particular advantages with respect to protection of metallic work pieces from corrosion have been found at a pH value of from 8 to 10. Usually, an appropriate pH value will be automatically achieved, simply by dissolving the already specified amounts of tetraborate component(s) and condensed phosphate component(s) in water. However, it may be desirable in some cases to adjust the pH value to the indicated range by the addition of basic substances, for example alkali metal hydroxides such as sodium hydroxide or potassium hydroxide. This by no means adversely affects the inhibition of corrosion on the work pieces treated with the inhibitors according to the invention. Moreover, no precipitates will be formed by such pH adjustment from the components required in the aqueous solutions of the inhibitors according to the invention.

Because aqueous solutions of condensed phosphates, for example tetrasodium pyrophosphate or of pentasodium tripolyphosphate, do not inhibit the corrosion on metallic work pieces under the conditions indicated and aqueous solutions of tetraborate alone exhibit only a moderate corrosion-inhibiting effect, it was surprising that aqueous solutions of the inhibitors according to the invention give excellent results in corrosion inhibition.

In addition, the inhibitors according to the invention are advantageous because any substantial formation of precipitates or poor solubility of the components in water are not observed in most cases. Usually, clear solutions are readily formed within a short time upon introduction of the powdered components into water of conventional hardness or into partially or fully deionized water as well. These clear solutions may be applied onto the work pieces in a conventional manner, for example by spraying, immersing, or a combined spray-immersion procedure, and impart a good to very good protection from corrosion, clearly surpassing the effectiveness of inhibitors containing nitrites or benzoates.

A particularly good inhibition of corrosion on metallic workpieces is achieved by using a treating mixture which contains the following components:

(a) one or more water-soluble tetraborate(s) in a total amount of from 8 to 18 grams per liter ($g \cdot l^{-1}$), (b) one or more water-soluble condensed phosphate(s) in a total amount of from 2 to 12 $g \cdot l^{-1}$, and (c) water.

Particularly preferred is the use of sodium tetraborate as the tetraborate component and of pentasodium tripolyphosphate as the condensed phosphate component.

As will be apparent from the following examples, inhibitors according to the invention reliably inhibit corrosion on both freshly exposed and pre-existing metal surfaces, when they are used in the form of their aqueous solutions having a total solids content of from 1 to 5% by weight at a pH value within the range of from 7 to 11.

It is not necessary to add other components to such aqueous solutions. However, for certain fields of application it may be desirable to add other components to accomplish additional purposes, such as degreasing and defoaming, or to further improve the desired corrosion inhibition. Typical components which may be so added are:

1. Anionic surfactants such as arylsulfonates, glycerol phosphates, ethersulfonates and the like;

2. Cationic surfactants such as sulfonium salts, quinolinium salts, tropylium salts and the like;

3. Zwitterionic surfactants such as betaines and the like;

4. Nonionic surfactants such as polyglycol ethers, polyalcohols, polyglycol esters and the like.

The invention is further illustrated, but not limited, by the following operating and comparison examples. In these examples, the inhibitory effectiveness was determined as follows: The inhibitors according to the invention were prepared in the form of aqueous solutions containing the tetraborate-condensed phosphate mixtures in an amount of from 1 to 5% by weight of solids, and the solutions were contacted with metal chips, in accordance with the procedures of DIN 51 360. In the preparation of these aqueous solutions, water which had been standardized according to Part 2 of the same DIN was used for carrying out the so-called "chip test". The corrosion was also evaluated in accordance with the above DIN procedure, on a scale on which a rust degree of 0 denotes "no corrosion" and a rust degree of 4 denotes "severe corrosion".

The following salts were used as the active components of the inhibitors; the parenthetical letters before the formulas of the salts are used to identify the salts in Table 1: (A) $Na_2B_4O_7 \cdot 10H_2O$; (B) $Na_5P_3O_{10}$; (C) $Na_4P_2O_7 \cdot 10H_2O$.

EXAMPLES 1 TO 8

The active components were mixed together in the ratios by weight shown in Table 1, completely dissolved in concentrations of from 1 to 2% by wight in standard water according to DIN 51360 (Part 2) in the concentrations shown in Table 1, and then tested with iron chips according to said DIN method. The results are shown in the following Table 1.

TABLE 1

Test of the Inhibitory Effect of Inhibitors According to the Invention

| Example Number | Tetraborate Type | Tetraborate $g \cdot l^{-1}$ | Phosphate Type | Phosphate $g \cdot l^{-1}$ | Rust Degree |
|---|---|---|---|---|---|
| 1 | A | 18 | B | 2 | 0 |
| 2 | A | 2 | B | 18 | 4 |
| 3 | A | 4 | B | 16 | 3 |
| 4 | A | 6 | B | 14 | 1 |
| 5 | A | 8 | B | 12 | 0 |
| 6 | A | 9 | B | 1 | 3 |
| 7 | A | 19.8 | B | 0.2 | 3 |
| 8 | A | 10 | C | 10 | 0 |

The inhibitors, particularly the compositions of Examples 1, 5 and 8, wherein the tetraborate component and condensed phosphate component are present in the preferred range of amounts, exhibit an outstanding anticorrosive effect.

COMPARATIVE EXAMPLES 1 TO 5

In the manner described above aqueous solutions each containing only one of the above-identified components (A) to (C), or other inhibitors taught in prior art, were employed in the examination of the corrosion-inhibiting effect. The results are shown in the following Table 2.

TABLE 2

Test of the Corrosion-Inhibiting Effect of the Individual Components and Some Prior Art Inhibitors

| Comparative Example Number | Component | $(g \cdot l^{-1})$ | Rust Degree |
|---|---|---|---|
| 1 | A | 20 | 2 |
| 2 | B | 20 | 4 |

TABLE 2-continued

Test of the Corrosion-Inhibiting Effect of the Individual Components and Some Prior Art Inhibitors

| Comparative Example Number | Component | $(g \cdot l^{-1})$ | Rust Degree |
|---|---|---|---|
| 3 | C | 20 | 2 |
| 4 | $NaNO_2$ | 20 | 4 |
| 5 | D | 20 | 2 |

Note: D is a commercially available ethanolamine-based anticorrosive agent.

The individual components (A) through (C) alone and the prior art inhibitors shown in Table 2 had only a moderately good to totally unsatisfactory effect. It is only the combination according to the ratios of this invention that resulted in highly effective inhibition. Moreover, it is again noted that these prior art inhibitors are hazardous to health.

COMPARATIVE EXAMPLE 6 AND EXAMPLE 9

In a so-called "open chip test" an aqueous solution containing 2% by weight of $NaNO_2$ was compared to an aqueous solution containing 2% by weight of sodium tetraborate and pentasodium tripolyphosphate in a ratio of 1:1. To this end, 3 g of degreased cast iron chips (particle size in the range of from 0.4 to 1.2 mm) were poured on a filter paper having a surface of 6.5 $cm^2$. The test solution were spot-dropped onto this layer of metal chips, and the metal chips were then dried over a period of 16 hours.

Upon completion of drying the cast iron chips and the filter paper were investigated for rust, and the rust property was evaluated in the manner described above. The treatment of the cast iron chips with aqueous sodium nitrite solution resulted in a rust degree of 4 (severe corrosion), whereas the treatment of the chips with an aqueous solution of the inhibitors according to the invention resulted in a complete inhibition of the corrosion; the rust degree was zero.

EXAMPLE 10 AND COMPARATIVE EXAMPLE 7

Gas cylinders for bottling and storing pressurized gases were mechanically cleaned on their internal surfaces, so that these inner surfaces were activated. For the examination of pressure-tightness the cylinders were then filled with either regular tap water or water containing inhibitors according to the invention. Upon the subsequent investigation of the metal internal surfaces it was found that the cylinders tested with pure water exhibited corroded inner surfaces, whereas the inner surfaces of the cylinders tested with pressurized water samples containing an anticorrosive agent according to the invention as additive were free from corrosion.

EXAMPLE 11 AND COMPARATIVE EXAMPLE 8

Test sheets made of substantially pure copper were cleaned with nitric acid so that a bright metal surface was obtained. The bright copper sheets were then immersed in aqueous solutions which contained, on the one hand, an ethanolamine-based commercially available passivating agent and, on the other hand, the anticorrosive agent according to Example 5, each in an amount of 2% by weight. Upon treatment with the ethanolamine-based commercially available agent the bright copper surface turned visibly duller, and the aqueous solution turned dark blue due to the formation of copper hexammine complexes. In contrast, the copper surface remained bright upon treatment with the anticorrosive agent of Example 5. No noticeable removal of copper by dissolution could be observed.

What is claimed is:

1. A process for inhibiting the corrosion of a metal surface by contact between said metal surface and an aqueous solution consisting essentially of:

(a) a component selected from the group of water-soluble alkali metal tetraborate salts;

(b) a component selected from the group of water-soluble alkali metal tripolyphosphate salts; and (c) water; and, optionally, (d) a component of one or more surfactants.

2. A process according to claim 1, wherein the total amount of components (a) and (b) is from about 1 to about 5% by weight of the total solution.

3. A process according to claim 2, wherein said aqueous solution contains component (a) in a concentration of from about 8 to about 18 $g \cdot l^{-1}$ and contains component (b) in a concentration of from about 2 to about 12 $g \cdot l^{-1}$.

4. A process according to claim 1, wherein said aqueous solution contains component (a) in a concentration of from about 8 to about 18 $g \cdot l^{-1}$ and contains component (b) in a concentration of from about 2 to about 12 $g \cdot l^{-1}$.

5. A process according to claim 4, wherein the ratio by weight between components (a) and (b) is about 1:1.

6. A process according to claim 3, wherein the ratio by weight between components (a) and (b) is about 1:1.

7. A process according to claim 2, wherein the ratio by weight between components (a) and (b) is about 1:1.

8. A process according to claim 1, wherein the ratio by weight between components (a) and (b) is about 1:1.

9. A process according to claim 8, wherein component (a) consists essentially of sodium tetraborate and component (b) consists essentially of pentasodium tripolyphosphate.

10. A process according to claim 7, wherein component (a) consists essentially of sodium tetraborate and component (b) consists essentially of pentasodium tripolyphosphate.

11. A process according to claim 6, wherein component (a) consists essentially of sodium tetraborate and component (b) consists essentially of pentasodium tripolyphosphate.

12. A process according to claim 5, wherein component (a) consists essentially of sodium tetraborate and component (b) consists essentially of pentasodium tripolyphosphate.

13. A process according to claim 4, wherein component (a) consists essentially of sodium tetraborate and component (b) consists essentially of pentasodium tripolyphosphate.

14. A process according to claim 3, wherein component (a) consists essentially of sodium tetraborate and component (b) consists essentially of pentasodium tripolyphosphate.

15. A process according to claim 2, wherein component (a) consists essentially of sodium tetraborate and component (b) consists essentially of pentasodium tripolyphosphate.

16. A process according to claim 1, wherein component (a) consists essentially of sodium tetraborate and component (b) consists essentially of pentasodium tripolyphosphate.

* * * * *